US006635105B2

(12) United States Patent
Ahlborn et al.

(10) Patent No.: US 6,635,105 B2
(45) Date of Patent: Oct. 21, 2003

(54) ELECTROSTATIC PRECIPITATOR

(75) Inventors: Stephan Ahlborn, Senden (DE); Heiko Schumann, Münster (DE)

(73) Assignee: Ing. Walter Hengst GmbH & Co. KG, Muenster (DE)

( * ) Notice: Subject to any disclaimer, the term of this patent is extended or adjusted under 35 U.S.C. 154(b) by 0 days.

(21) Appl. No.: 10/070,865

(22) PCT Filed: Jun. 30, 2001

(86) PCT No.: PCT/DE01/02487

§ 371 (c)(1),
(2), (4) Date: Jul. 10, 2002

(87) PCT Pub. No.: WO02/04126

PCT Pub. Date: Jan. 17, 2002

(65) Prior Publication Data

US 2002/0194997 A1 Dec. 26, 2002

(51) Int. Cl.[7] ..... B03C 3/74

(52) U.S. Cl. ..... 96/28; 96/29; 96/51; 96/97; 134/6; 134/8

(58) Field of Search ..... 96/51, 28, 29, 96/96, 97; 95/76, 74; 134/6, 9, 8

(56) References Cited

U.S. PATENT DOCUMENTS 4,318,718 A * 3/1982 Utsumi et al. ..... 96/51
6,348,103 B1 * 2/2002 Ahlborn et al. ..... 134/6

FOREIGN PATENT DOCUMENTS

DE 198 22 332 C1 5/1999
EP 0 433 152 A1 6/1991
FR 2704776 A1 * 11/1994 ..... B03C/3/88

* cited by examiner

*Primary Examiner*—Richard L. Chiesa
(74) *Attorney, Agent, or Firm*—Lahive & Cockfield, LLP

(57) ABSTRACT

The invention relates to an electrostatic precipitator for collecting liquid or solid particles from a gas stream. The electrostatic precipitator consists of a tube (1), through which the gas to be cleaned flows longitudinally, the internal wall (1A) of the tube forming a precipitating electrode for the particles to be collected. An internal electrode (2) extending in a lengthwise direction is disposed concentrically inside tube (1), a high electrical voltage being present in the space between this internal electrode and the precipitating electrode. On the inlet side, internal electrode (2) has a first section (2A) with a small cross-sectional area, and on the outlet side, a second section (2B) with a comparatively larger cross-sectional area. The function of the first section is essentially to form a corona while that of the second section is essentially to form an electrostatic collecting field. A cleaning body (3) is provided to clean the section of the internal electrode forming the corona, the cleaning body being moved relative to and in physical contact with the internal electrode so as to clean the section of the internal electrode forming the corona. The actuating element (4) effecting the relative movement is arranged in a space-saving manner inside the hollow internal electrode (2).

15 Claims, 3 Drawing Sheets

ELECTROSTATIC PRECIPITATOR

RELATED APPLICATIONS

This application is a 35 U.S.C. 371 national stage filing of, and claims priority to, International Application No. PCT/DE01/02487, filed Jun. 30, 2001, which in turn claims priority to German Patent Application No. 100 33 642.6 filed on Jul. 11, 2000 in Germany. The contents of the aforementioned applications are hereby incorporated by reference.

BACKGROUND OF THE INVENTION

The invention relates to an electrostatic precipitator for collecting liquid or solid particles from a gas stream.

Electrostatic precipitators of this type are known from German Patent 198 22 332 C1. The patent describes an actuating means (for example, a thermally actuatable wax expansion element) which moves the cleaning body and is located outside the tube forming the precipitating electrode, which actuating means is movably connected to the cleaning body via a bracket arm and a retaining arm. This system requires additional space in which to configure and accommodate the actuating means, this space becoming unavailable for many applications, for example, for operating an electrostatic precipitator attached to an internal combustion engine.

The goal of the invention is therefore to develop an electrostatic precipitator for cleaning the section of the internal electrode which forms the corona while featuring a compact and space-saving design.

SUMMARY OF THE INVENTION

The basic principle of the invention is to advantageously make available previously unused space by exploiting the hollow shape of the internal electrode in that section in which the internal electrode has a larger diameter, this space being used to accommodate the components operating the cleaning mechanism.

Integration of the actuating element and/or associated power-transmission means in the internal electrode achieves the overall goal of a compact and space-saving design for the electrostatic precipitator. No more space is required for the electrostatic precipitator according to the invention than would be required for an electrostatic precipitator in which the corona region of the internal electrode is not cleaned. The need for an attachment of components additional to the tube forming the precipitating electrode is entirely eliminated or kept to a minimum.

Embodiments of the invention will be explained in more detail based on the drawing.

DESCRIPTION OF ILLUSTRATED EMBODIMENT

Figure 1:
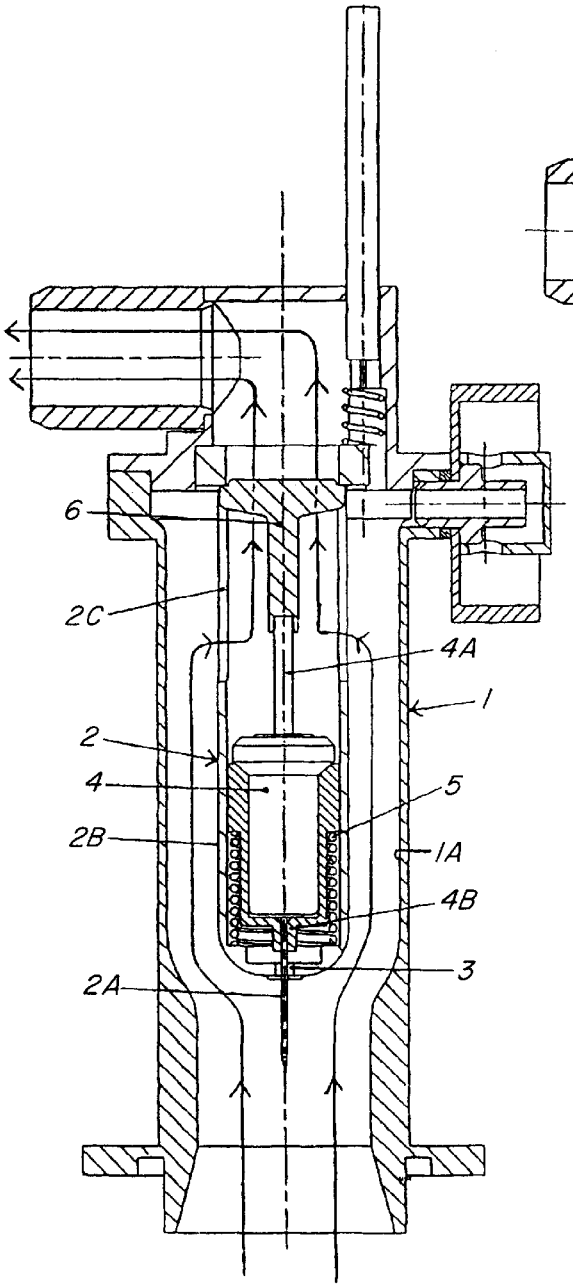
FIG. 1 shows a section through a first embodiment of the electrostatic precipitator in which a needle forming the second section of the internal electrode is slid over a fixed cleaning body to effect cleaning, this electrostatic precipitator being employed in an internal combustion engine and shown in its position with the engine running.
Figure 2:
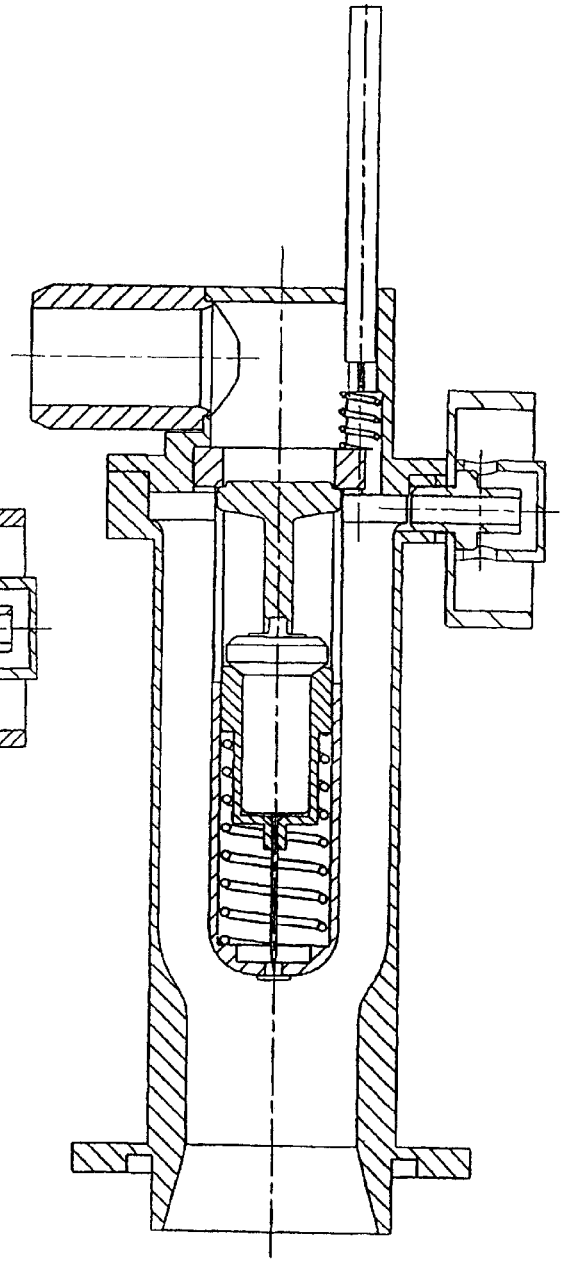
FIG. 2 provides the same view as FIG. 1 in the position with the engine shut off.

FIG. 1 and FIG. 2 each show a section through a first embodiment of the electrostatic precipitator which is employed preferably in an internal combustion engine for removing the oil from crankcase gases. FIG. 1 shows the electrostatic precipitator in its position with the engine running while FIG. 2 shows the electrostatic precipitator with the engine turned off. The electrostatic precipitator consists of a tube (1) through which the gas to be cleaned flows in a lengthwise direction and in which its internal wall (1A) forms a precipitating electrode for the collecting particles. Disposed concentrically inside tube (1) is an internal electrode (2) extending in a lengthwise direction, a high electrical voltage being present in the space between this internal electrode (2) and precipitating electrode (1A). On the inlet side, internal electrode (2) has a first section (2A) with a small cross-sectional area, and on the outlet side, a second section (2B) with a comparatively larger cross-sectional area. The function of first section (2A) is essentially to form a corona while that of second section (2B) is essentially to form an electrostatic collecting field. This two-stage design of internal electrode (2), in which the corona is restricted to a certain section (2A) and does not extend over the entire length of internal electrode (2), ensures in known fashion the economical operation of the electrostatic precipitator in terms of the electrical power required, while at the same time ensuring efficient collection. The preferred design here for the section (2A) of the internal electrode (2) forming the corona is preferably as a needle. However, a design may also be provided, for example, in which the first section (2A) forming the corona is conical on the inlet side or a generally tapered extension of second section (2B) of internal electrode (2).

A cleaning body (3) is provided to clean needle (2A). Cleaning is performed by a relative movement of cleaning body (3) relative to needle (2A), in physical contact with the latter. The actuating means (4) to produce this relative movement is located, according to the invention, in the hollow second section (2B) of internal electrode (2). In the embodiment shown in FIGS. 1 and 2, to effect cleaning needle (2A) slides over fixed cleaning body (3), while in the embodiments shown in FIGS. 3 through 7, cleaning body (3) slides over fixed needle (2A).

When using the electrostatic precipitator attached to an internal combustion engine, an actuating means (4) is preferred which effects the relative movement between the cleaning bodies by utilizing engine-inherent energies such as temperature or pressure differences, or vibrations. When using the electrostatic precipitator for removing the oil crankcase gases, an expansion element (4) is preferably used which expands when the engine is running as a result of heat input from the hot crankcase gases, thereby exerting a force on a plunger (4A) which extends against a counteracting spring. When the engine is off, the temperature drops to ambient levels and the plunger (4A) is retracted by the action of a spring (5). Spring (5) is also accommodated in the hollow internal electrode (2) and may be designated as a return actuating element. Needle (2A) is located in a sleeve (4B) connected on the inlet side with expansion element (4). The needle may, for example, be pressed into this sleeve. Sleeve (4B) may be connected to expansion element (4) as a single piece, or attached to this element as a separate component. Plunger (4A) is located on the side of expansion element (4) opposite needle (2A), this plunger being supported inside hollow internal electrode (2) on a fixed pin (6) therein which acts a support. Spring (5) is supported on one side by a contour of internal electrode (2), and on the other side by a projection of expansion element (4) or by a projection of the body (for example, the above-mentioned sleeve) surrounding the expansion element.

Cleaning body (3) is preferably located at the inlet end of hollow second section (2B) of internal electrode (2). To accommodate it, internal electrode (2) has a small opening there into which cleaning body (3) is pressed or clipped. The cleaning body (3) itself is preferably formed from an elastomer lamella which is pierced by needle (2A) for cleaning. However, the invention also provides, for example, for designing the cleaning body as a cleaning brush with radially inward-projecting microbristles.

The operating principle of the needle cleaning according to the embodiment of FIGS. 1 and 2 is the following: After the engine is switched on, the hot crankcase gases, as well as the entire engine compartment, heat up expansion element (4). In response, plunger (4A) supported against pin (6) extends and pushes expansion element (4) along with its attached needle (2A) downward, in the drawing, against the force of spring (5). As a result, needle (2A) pierces cleaning body (3). When the engine is running and the electrostatic precipitator is operating, needle (2A), functioning as the section of the internal electrode (2) forming the corona, projects from the second section (2B) of internal electrode (2). When the engine is off and cooled, pretensioned spring (5) returns expansion element (4) along with needle (2A), thereby retracting plunger (4A). During this movement, needle (2A) is cleaned during retraction by contact with cleaning body (3), the contamination being stripped off.

In order to heat up expansion element (4) and thus move needle (2A) into the operating state as quickly as possible after the engine is switched on, the hot crankcase gases are diverted through hollow electrode (2) in which expansion element (4) is of course located. Hollow electrode (2) has inlet openings (2C) for the gas, which connect the space between internal electrode (2) and precipitating electrode (1A) with the cavity in internal electrode (2). These openings are preferably designed as slots (2C) oriented longitudinally to internal electrode (2). A pin (6), which also serves as an end support for plunger (4A), is advantageously inserted through these slots (2C) into internal electrode (2), and held in place there. The diversion of the cleaned gas through hollow internal electrode (2) additionally enables the electrostatic precipitator to have a compact design.

In the embodiment of FIGS. 1 and 2, needle (2A) is maintained at the same potential as internal electrode (2) via sleeve (4B) which is in electrically conductive contact with the second hollow section (2B) of internal electrode (2).

Creation of a smaller diameter for tube (1) may be achieved by modifying the embodiment of FIGS. 1 and 2 so that expansion element (4) is not located completely inside tube (1) but instead only plunger (4A) of expansion element (4) extends into tube (1), in other words, so that the main body of expansion element (4) in the drawing is located, for example, above plunger (4A).

In the embodiment of FIGS. 3 through 7, needle (2A) is permanently attached (for example, pressed into) to the second hollow section (2B) of internal electrode (2). Here cleaning body (3) moves while needle (2A) remains fixed in place. To achieve this, a retaining element (8) for cleaning body (3) is provided which is connected to plunger (4A) of expansion element (4), this retaining element (8) moving along with plunger (4A). To receive retaining element (8) in a longitudinally movable manner and to connect retaining element (8) with plunger (4A), hollow internal electrode (2) has longitudinally oriented slots (2C). In this case as well, the slots (2C) serve to divert the hot crankcase gases through hollow internal electrode (2). In the variant shown, retaining element (8) is designed as a retaining bracket which, on the inlet side, has a ring (8A) to accommodate cleaning body (3). The gas to be cleaned may flow past the connecting members (8B), which hold cleaning body (3) concentrically inside ring (8A), into tube (1). To center cleaning body (3) in alignment with needle (1A), retaining bracket (8) is aligned coaxially by ring (8C) inside precipitating electrode (1A). This arrangement is illustrated more clearly in FIG. 7. It ensures that cleaning ring (3) is always pierced by needle (2A) in the same place. This feature is advantageous particularly when cleaning body (3) has an elastomer composition since the elastomer would otherwise be quickly destroyed by a plurality of puncture points, whereas the electrostatic precipitator is designed to be a maintenance-free, durable component.

Figure 3:
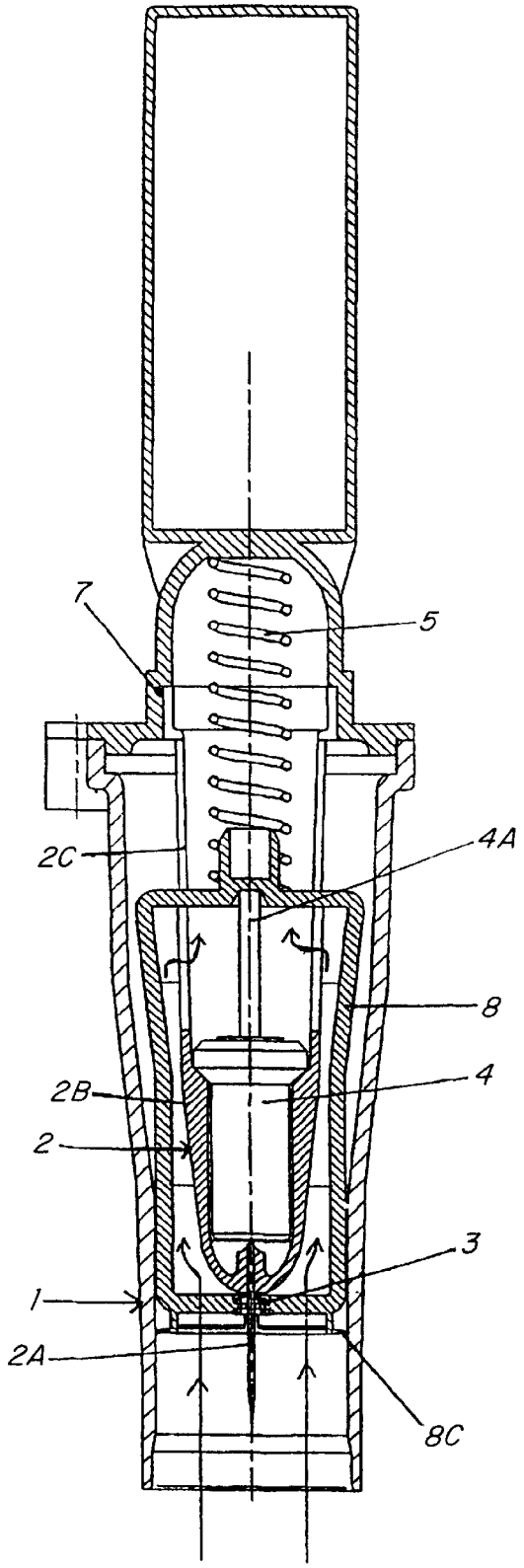
FIG. 3 shows a section through a second embodiment of the electrostatic precipitator in which a needle forming the first section of the internal electrode is slid over a fixed cleaning body to effect cleaning, this electrostatic precipitator being employed in an internal combustion engine and shown in its position with the engine running.
Figure 4:
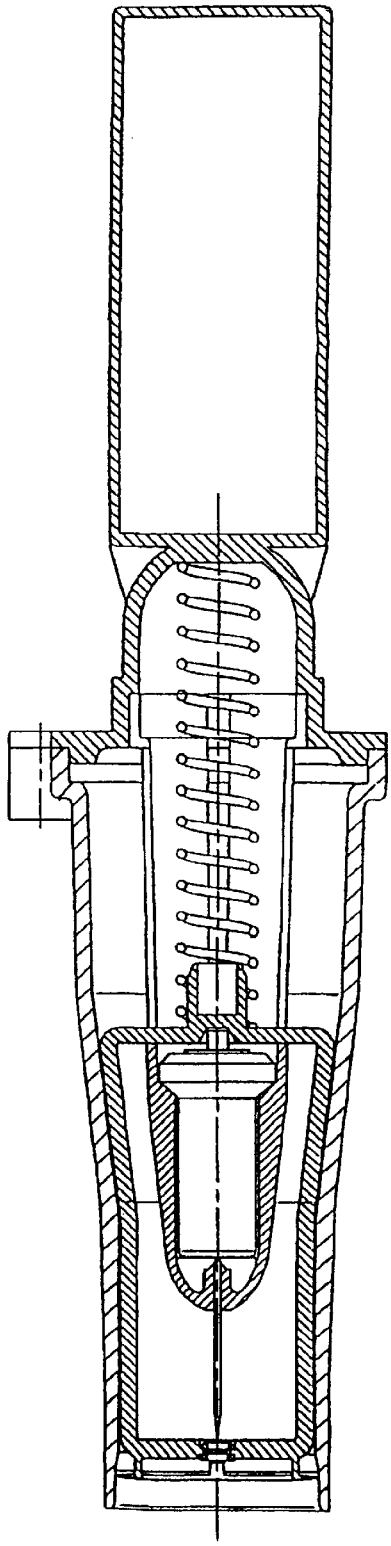
FIG. 4 provides the same view as FIG. 3 in the position with the engine shut off.
Figure 5:
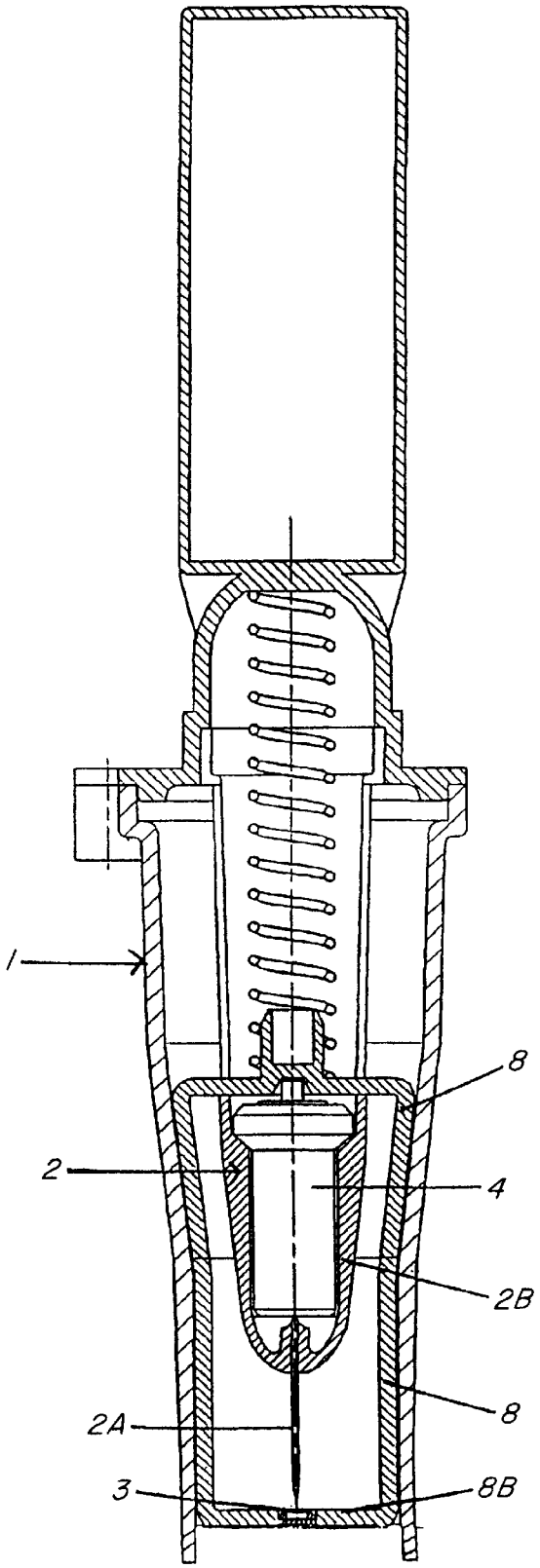
FIG. 5 shows a section through a third embodiment of the electrostatic precipitator.
Figure 6:
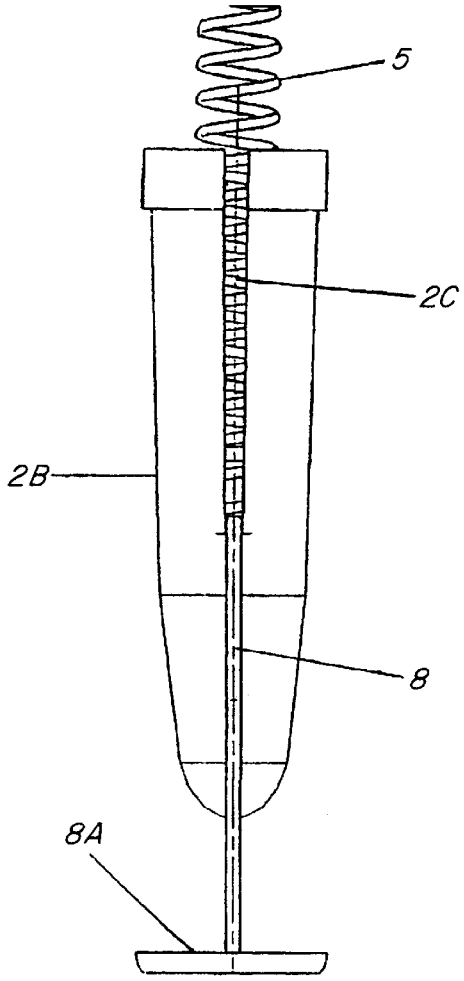
FIG. 6 shows a side view of a hollow, slotted internal electrode with a retaining element for the cleaning body.
Figure 7:
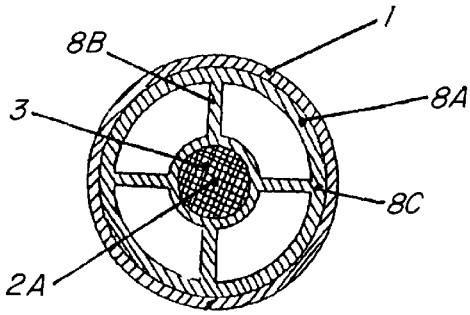
FIG. 7 shows a cross section through the precipitating electrode in the region of the cleaning body and of the retaining element.

In the embodiment shown in FIGS. 3 through 5, spring (5) is supported at one end by retaining element (8), and at the other end by a closing cap (7) which closes tube (1).

As shown in FIGS. 3 and 4, retaining element (8) also has a circumferential cleaning lip (8C) for cleaning precipitating electrode (1A). Advantageously, both needle (2A) and precipitating electrode (1A) may thus be cleaned simultaneously by a single mechanism. In addition, cleaning lip (8C) may also serve—as mentioned above—to center cleaning body (3).

In an embodiment not shown, the plunger of the expansion element is designed as the needle forming the corona, the spring resting here on a support collar connected to the plunger.

Instead of employing an expansion element plus spring to effect the relative movement between the cleaning body and needle, it is also possible, for example, to use as an actuating element a motor-driven threaded spindle running through the hollow internal electrode. It is also possible to provide a cylinder operated by oil pressure or air pressure as the actuating element, the cylinder in this case extending at least along part of the hollow internal electrode.

One aspect of the invention which is independent of the corona-forming needle is the exclusive cleaning of the precipitating electrode by an actuating mechanism located in the cavity of the internal electrode. For example, retaining element (8), as shown in FIGS. 3 and 4, may be used to form a cleaning device, the retaining element here having only one circumferential cleaning lip (8C). In this case, retaining element (8) is not required to accommodate cleaning body (3).

List of Drawing References

1) tube

1*a*) internal wall/precipitating electrode

2) internal electrode

2*a*) first section of internal electrode/needle

2*b*) second section of internal electrode

2*c*) slots in internal electrode

3) cleaning body

4) actuating means (expansion element) for effecting the relative movement of cleaning body and needle

4*a*) plunger

4*b*) sleeve on expansion element to accommodate needle

5) spring

6) pin functioning as end support for plunger

7) closing cap of tube

8) retaining element for cleaning body

8*a*) ring

8*b*) connecting members

8*c*) cleaning lip for precipitating electrode

What is claimed is:

1. Electrostatic precipitator for collecting liquid or solid particles from a gas stream, comprising a tube through which the gas stream to be cleaned flows longitudinally and in which an internal wall forms a precipitating electrode for collecting particles, an internal electrode disposed concentrically and longitudinally inside the tube, wherein a high electrical voltage is present in a space formed between the internal electrode and the precipitating electrode, the internal electrode having a first section with a small cross-sectional area on an inlet side, and a second section with a larger cross-sectional area on an outlet side, the first section being configured to form the corona, and the second section being configured to form an electrostatic collecting field, a cleaning body for cleaning the first section of the internal electrode, the cleaning being effected by relative movement of the cleaning body against the first section of the internal electrode, and at least one actuator to effect the relative movement between the cleaning body and the first section of the internal electrode, wherein at least the second section of the internal electrode (2) is hollow, and a cavity of the internal electrode is sized to accommodate at least one of a portion of the actuator and at least one power-transmission means connected to the actuator for effecting the relative movement between the cleaning body and the first section of the internal electrode.

2. Electrostatic precipitator according to claim 1, wherein the precipitator is attached to an internal combustion engine, and wherein the actuator effects the relative movement between the cleaning body and the first section of the internal electrode by utilizing engine-inherent energies.

3. Electrostatic precipitator according to claim 2, wherein the actuator comprises an expansion element which is coupled to an engine-inherent energy source, and wherein when the engine is running, the expansion element holds, against a counteracting spring, the first section of the internal electrode in a first position relative to the cleaning body which is fixed inside the electrostatic precipitator, and when the engine is off, the first section of the internal electrode is held by a spring in a second position relative to the cleaning body which is fixed inside the electrostatic precipitator, the second position being a certain distance removed along a lengthwise axis of the internal electrode from the first position.

4. Electrostatic precipitator according to claim 3, wherein one of the expansion element and the spring is located at least partially inside the cavity of the internal electrode.

5. Electrostatic precipitator according to claim 3, wherein the cleaning body is fixed to the second section of the internal electrode.

6. Electrostatic precipitator according to claim 3, wherein the cleaning body is fixed by one or more connecting members concentrically inside the tube forming the precipitating electrode.

7. Electrostatic precipitator according to claim 2, wherein the actuator comprises an expansion element which is coupled to an engine-inherent energy source, wherein when the engine is running, the expansion element holds, against a counteracting spring, the cleaning body in a first position relative to the fixed first section, and when the engine is off, the cleaning body is held by a spring in a second position relative to the fixed first section of the internal electrode, the second position being a certain distance removed along a lengthwise axis of the internal electrode from the first position.

8. Electrostatic precipitator according to claim 7, wherein one of the expansion element and the spring is located at least partially inside the cavity of the internal electrode.

9. Electrostatic precipitator according to claim 7, wherein the internal electrode has at least one slot formed in the second section of the internal electrode, said slot extending along a lengthwise direction of the internal electrode for accommodating longitudinally movement of a retaining element of the cleaning body, wherein the retaining element of the cleaning body is movably coupled to the expansion element.

10. Electrostatic precipitator according to claim 9, wherein the retaining element extends coaxially at least through a partial region of the precipitating electrode to center the cleaning body.

11. Electrostatic precipitator according to claim 10, wherein the retaining element for the cleaning body has a circumferential cleaning lip for the precipitating electrode that abuts the precipitating electrode, said lip being adapted to center the cleaning body.

12. Electrostatic precipitator for collecting liquid or solid particles from a gas stream, comprising a tube through which the gas to be cleaned flows longitudinally and in which the internal wall forms a precipitating electrode for collecting particles, and an internal electrode disposed concentrically and longitudinally inside the tube, wherein a high electrical voltage is present in a space formed between the internal electrode and the precipitating electrode, the internal electrode having on an inlet side a first section with a small cross-sectional area, and on an outlet side, a second section with a larger cross-sectional area, the first section being configured to form the corona, and the second section being configured to form an electrostatic collecting field, wherein at least the second section of the internal electrode is at least partly hollow, and a cavity of the internal electrode is sized to accommodate at least one of a portion of an actuator and at least one power-transmission means connected to the actuator, said actuator being operatively coupled to a cleaning device to clean the precipitating electrode.

13. Electrostatic precipitator according to claim 12, wherein the internal electrode has in the second section at least one slot extending along a lengthwise direction of the internal electrode for accommodating longitudinally move ment of a cleaning device, the cleaning device being coupled with the actuator for effecting the movement of the cleaning device through the cavity of the internal electrode.

14. Electrostatic precipitator according to claim 12, wherein the cleaning device has a circumferential cleaning lip abutting the precipitating electrode.

15. Electrostatic precipitator according to claim 12, wherein the cleaning device is formed from an elastomer which is pierced by a first section of the internal electrode which is configured as a needle.

* * * * *